United States Patent [19]

Robertson

[11] 4,227,267

[45] Oct. 14, 1980

[54] COVER FOR WATER CLOSET SEAT

[76] Inventor: Carl L. Robertson, Oklahoma City, Okla.

[21] Appl. No.: 6,427

[22] Filed: Jan. 25, 1979

Related U.S. Application Data

[63] Continuation-in-part of Ser. No. 945,200, Sep. 25, 1978, abandoned.

[51] Int. Cl.[3] ..... A47K 13/14

[52] U.S. Cl. ..... 4/234; 4/242

[58] Field of Search ..... 4/242, 234, 245, 244, 4/243

[56] References Cited

U.S. PATENT DOCUMENTS

| | | | |
|---|---|---|---|
| 2,608,694 | 9/1952 | McCamy | 4/242 |
| 2,994,887 | 8/1961 | Thornton | 4/242 |
| 3,102,276 | 9/1963 | Warnberg | 4/242 |

*Primary Examiner*—Lenard A. Footland

*Attorney, Agent, or Firm*—William R. Laney

[57] ABSTRACT

A cover for a water closet seat which includes an annular panel of flexible fabric having an inner peripheral edge and an outer peripheral edge, and adapted to fit across and cover the upper surface of a water closet seat. A band of resilient material is mounted at and around the outer peripheral edge of the panel and constrictively urges the outer peripheral edge to a contracted, converged position. A hem channel is carried by the panel at its inner periphery, and is transversely traversed by a channel closure which blocks the channel at one point around its peripheral extent. At a location spaced along the hem channel from the channel closure, a channel opening is provided. A two-ended, resilient stiffening member is positioned in the channel with the two ends thereof abutting the channel closure.

10 Claims, 6 Drawing Figures

COVER FOR WATER CLOSET SEAT

RELATED APPLICATIONS

This application is a continuation-in-part of my U.S. application Ser. No. 945,200 filed Sept. 25, 1978, now abandoned, and entitled "Cover for Water Closet Seat."

BACKGROUND OF THE INVENTION

1. Field of the Invention

This invention relates to covers for water closet seats, and more particularly, to soft, flexible fabric covers which are stretched across the upper side of a water closet seat to improve the aesthetics of the seat and also the comfort of the user.

2. Brief Description of the Prior Art

A number of types of covers for toilet seats have been proposed in the past. Two of the most successful of these are those disclosed in Thornton U.S. Pat. No. 2,994,887 and in Warnberg U.S. Pat. No. 3,102,276.

In the Thornton patent, a fabric cover panel for the seat is provided and is retained on the seat by means of a resilient or elastic band secured around the fabric panel at its outer periphery, and a length of wire mounted around the inner peripheral edge of the panel. The elastic band functions to draw the outer peripheral edge of the panel under the seat and hold it at that location after the cover is installed. The wire or other stiffening member secured to the inner peripheral edge of the panel functions to hold the fabric panel in position by expanding so as to force the inner peripheral edge of the panel outwardly beneath the under side of the seat after the stiffening member has been pushed through the seat opening.

In the Thornton seat cover, the wire stiffening member utilized is inserted in one of the two facing open ends provided in a hem formed around the inner peripheral edge of the fabric panel. As explained in the Warnberg patent which subsequently issued, the Thornton cover has certain disadvantages, and can pose a danger in use due to exposed, relatively sharp ends of the wire or other stiffening member, which is almost all usages of the cover will project out from the open ends of the channel or hem, and thus will provide a hazard to the user of the water closet.

In U.S. Pat. No. 3,102,276 later issued to A. E. Warnberg, the patentee has undertaken to correct the acknowledged deficiencies of the Thornton seat cover by using an endless, entrapped wire or other stiffening member of annular configuration permanently secured around the inner peripheral edge of the fabric panel. In such seat cover as proposed by Warnberg, the described hazard of usage of sharp-ended wire or other stiffening member is obviated by complete enclosure of the endless stiffening member within a channel or hem which is provided. A problem which is experienced, however, with the cover of the type disclosed in the Warnberg patent is that any breaking of the wire which occurs over extended usage, particularly in the course of repeated launderings, and replacement on the water closet seat, completely destroys the utility of the cover, since the wire, once broken, does not function effectively and there is no way to remove the wire without slitting open the channel in which it is located and later resewing the panel to reinstall a new wire. The problems of such replacement and the expense of doing so exceed the cost of simply obtaining a new cover.

A further disadvantage which is characteristic of the Warnberg type seat cover is that the utilization of a wire as the internal stiffening member employed to bias the inner peripheral edge of the cover back up under the seat has either required the use of an expensive stainless steel or chrome plated wire to reduce ultimate rusting after numerous launderings or, where less expensive wire elements have been used, has led to an unsightly rusting problem in which rusting of the wire element discolors the cover and causes unsightly blotches thereon.

BRIEF DESCRIPTION OF THE PRESENT INVENTION

The present invention provides an improved cover for a water closet seat which is very utilitarian, facilitates ease of laundering of the cover, does not become unsightly as a result of rusting of any part thereof, and is of unusually long service life with very inexpensive and easily effected maintenance.

Broadly described, the cover for a water closet seat of the present invention includes an annular panel of a flexible fabric having an inner peripheral edge and an outer peripheral edge. The panel is dimensioned to fit across and cover the upper surface of a water closet seat with the peripheral edges overlapping the edges of the seat. A band of resilient material, such as elastic, is mounted at and around the outer peripheral edge of the panel and continuously, constrictively urges the outer peripheral edge to a contracted, converged condition. The resilient material band thus functions to draw the outer peripheral edge of the cover up in under the lower side of the water closet seat when the panel is installed on the seat.

A hem channel is carried by the panel at its inner periphery, and is transversely traversed by a channel closure which blocks the channel at one point around its peripheral extent. At a location spaced along the hem channel from the channel closure, a channel opening is provided. A two-ended resilient stiffening member is positioned in the channel with the two ends thereof abutting the channel closure.

An important object of the present invention is to provide a cover for a water closet seat which is safe to utilize, and which does not include any structural element which can stab or injure a person sitting on the seat when the cover is in place.

Another important object of the invention is to provide a cover for a water closet seat in which the cover includes an annular stiffening member carried at the inner peripheral edge of a flexible fabric panel forming the main portion of the cover, with the stiffening member being quickly and easily removable from a channel in which the stiffening member is mounted when it is desired to launder the cover, or when it is necessary to replace the stiffening member for any reason.

A further object of the invention is to provide a cover for a water closet seat which does not include any structural element which is susceptible to rusting or deterioration as a result of exposure to moisture over an extended service life.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
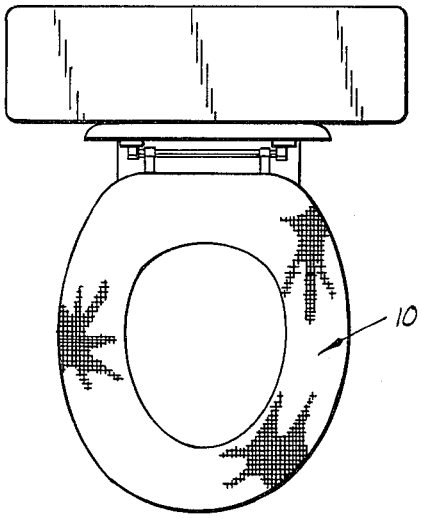
FIG. 1 is a top plan view of a water closet, including a water closet seat having the cover of the invention secured thereon.

Referring initially to the drawings, and particularly to FIG. 1 thereof, the water closet seat cover of the invention includes a substantially annular panel 10 of flexible fabric. The cover is shown mounted upon a water closet seat 11 of typically oval configuration, being narrower in transverse dimension than in its dimensions as measured from front to back. The panel 10 is correspondingly shaped so that it can be fitted neatly and aesthetically across the upper side of the water closet seat 11.

The flexible panel 10 is preferably a pile fabric having a plurality of fibers 13 projecting upwardly from one surface thereof so as to provide a soft feel and an aesthetic appearance.

The fabric panel 10 is characterized in having an outer peripheral edge 12 and an inner peripheral edge 14. At the outer peripheral edge, in the illustrated embodiment, an elongated band 16 of resilient material, such as elastic, is secured to the edge and thus assumes a generally circular closed figure configuration. The dimension of the band 16 is such that it is relatively shorter than the total length of the outer peripheral edge 12 of the panel 10 when it is in its relaxed or unexpanded state. Thus, when it is sewed to the outer peripheral edge 12 over the entire length of this edge, it is in an expanded state, and upon release will cause the outer peripheral edge of the panel to pucker or become constricted or contracted.

At the inner peripheral edge 14 of the panel 10, an elongated hem channel 20 is provided which extends over the entire length of the inner peripheral edge of the panel. The hem channel 20 can be formed in any suitable way, and in the illustrated embodiment, is formed by turning a portion of the inner peripheral edge 14 over upon itself to provide a closed substantially annular channel conforming in configuration to the inner edge of the panel 10. The turned over portion of the inner peripheral edge of the panel 10 which forms the hem channel is held in this position by suitable stitching (not shown).

Figure 4:
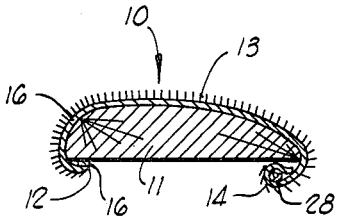
FIG. 4 is a sectional view taken along line 4—4 of FIG. 3.

At a selected point along the length of the hem channel 20, and preferably at a location which is centered at the rear portion of the panel 10 (that is, the portion which is to fit over and cover the rear portion of the water closet seat), a channel closure 24 is formed which blocks the channel at one point around its peripheral extent. In the illustrated embodiment of the invention, the channel closure 24 is formed by stitching across the channel to form a transverse wall at the location illustrated in FIG. 4.

Spaced from the channel closure 24 by a distance which is preferably from 1 to 4 inches from this closure, a channel opening 26 is formed through the fabric of the panel 10 at a location such that an opening to the interior of the hem channel 20 is provided. The opening is preferably from ½ to 3 inches in length. The channel opening 26 may be formed by an interruption of the hem stitching at this location, or it may be formed at any place around the periphery of the hem channel 20 so as to provide access to the interior of the channel. Preferably, the opening 26 into the hem channel 20 is stitched about its periphery to prevent fraying or unraveling of the fabric material of which the panel 10 is constructed.

An elongated resilient stiffening member 28 having ends 28*a* and 28*b* is positioned in the hem channel 20. The resilient flexible stiffening member 28, as well as the hem channel 20 in which it is located, has a length which is of greater dimension than the length of the inner periphery of the water closet seat upon which the cover is to be located. The reason for this relative dimensioning will subsequently be better understood from the ensuing description.

In the illustrated embodiment of the invention, the stiffening member 28 is a tubular member made of synthetic resin having elastic properties appropriate to the performance of the functions hereinafter described. The opposite ends 28*a* and 28*b* of the stiffening member are preferably radiused by thermal fusion, or other suitable means, so that they are blunt and cannot cut through or penetrate the fabric of the panel 10 or punch through the channel closure 24. It will be noted that as the stiffening member 28 is positioned in the hem channel 20, the ends 28*a* and 28*b* thereof are abutted against, and lie in immediate proximity to, the channel closure 24, and it will be further noted that an intermediate portion (that is, lying between the ends 28*a* and 28*b*) of the stiffening member 28 extends across or traverses the channel opening 26.

Figure 2:
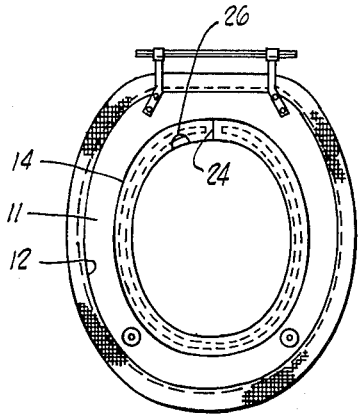
FIG. 2 is a bottom plan view of the water closet seat with the cover of the invention secured thereon.

In the use of the water closet seat cover of the invention, the flexible fabric panel 10 is first superimposed on the water closet seat 11 so that the central portion of this panel extends across and completely covers the upper surface of the seat. The outer peripheral edge 12 of the panel 10 is then pulled over and under the outer peripheral edge of the water closet seat. At this time, the resilient band 16 will, by reason of its propensity to constrict or contract the outer peripheral edge 12 of the panel 10, cause the outer peripheral edge of the panel to pull in underneath the water closet seat, and bear against the lower side or surface of the seat. This relative position of the outer peripheral edge 12 of the panel 10 is illustrated in FIG. 2.

After the outer peripheral edge has been positioned beneath the water closet seat in the way described, the inner peripheral edge 14, with the associated hem channel 20 and stiffening member 28 carried thereby, is pushed through the characteristic central opening of the water closet seat. In doing this, it is necessary to bunch or compress the resilient and flexible stiffening member so that it will pass through this opening. After the stiffening member has been passed through the opening from the top side of the seat to the lower side thereof, it is released and undergoes expansion to its normal, substantially relaxed state in which it assumes a substantially annular configuration in which it holds the inner peripheral edge of the cover up against the under side of the seat 11.

With the cover positioned in the manner described, it is retained in a set and unshifting position on the water closet seat. The coordinated actions of the resilient band 16 and the resilient, flexible stiffening member 28 assure that the panel 10 will be continuously drawn tautly across the upper side of the seat 30 to provide an aesthetic appearance. The elongated resilient stiffening member is prevented from shifting due to the abutment of its opposite ends 28*a* and 28*b* against the channel closure 24 which closes the hem channel 20 and thereby prevents the inadvertent exiting of either end of the stiffening member through the channel opening 26.

It will be perceived that use of the tubular synthetic resin stiffening member 28 obviates the problem of rusting characteristics of some types of water closet covers previously marketed. Moreover, and importantly, the relatively blunt ends 28*a* and 28*b* of the stiffening member 28 are completely entrapped and enclosed, and present no hazard to one who is sitting upon the cover when it is installed in its operative position. The stiffening member 28 is essentially completely entrapped and is prevented from shifting in any way which will cause wrinkling of the cover when installed.

An important feature of the invention is the ability to remove the stiffening member 28 for replacement, should it become worn or fractured, and more importantly, for cover laundering purposes. The resiliency of the stiffening member 28 is such that it can be easily bent and contracted to permit it to be extracted through the channel opening 26 which is provided at a selected distance from the transverse wall channel closure 24. The same facility of removal of the stiffening member 28 enables it to be quickly and easily replaced by inserting one end of the stiffening member through the channel opening 26 and threading that particular end around the hem channel 20 until the inserted end abuts the channel closure 24. The opposite end portion of the stiffening member 28 can then be bent into a configuration which enables a second end of the stiffening member 28 to be inserted through the channel opening 26. The stiffening member is then extended to the normal annular configuration in which this end portion passes into and fills that portion of the hem channel 20 extending between the channel opening 26 and the channel closure 24.

Figure 3:
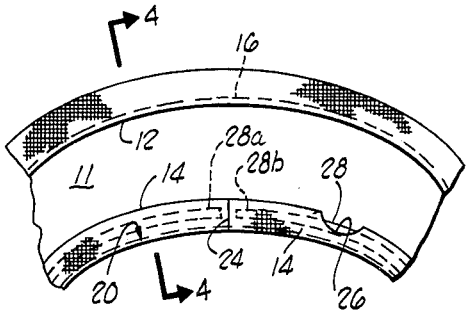
FIG. 3 is an enlarged detail view of a portion of the seat cover of the invention.
Figure 5:
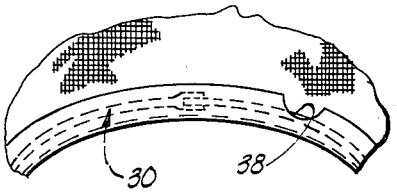
FIG. 5 is a fragmentary bottom plan view illustrating a modified embodiment of the invention.
Figure 6:
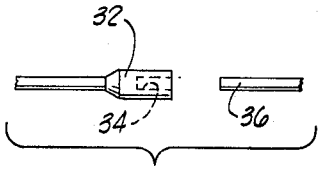
FIG. 6 illustrates the end portions of a stiffening member used in a modified embodiment of the invention.

A modified embodiment of the invention is illustrated in FIGS. 5 and 6. In the embodiment here illustrated, a modified stiffening ring in the form of a tubular synthetic resin element is provided, and is designated generally by reference numeral 30. The stiffening ring 30 is provided at one of its ends with an enlarged tubular or female socket 32 which includes an inwardly projecting bore 34. The socket 32 and bore 34 are dimensioned to receive the opposite end 36 of the tubular element when the stiffening member 30 is inserted in the hem channel 20. In inserting the stiffening ring into the channel, a notch 38 is provided similar to the notch 28 described in referring to the embodiment illustrated in FIGS. 1–3 and the channel closure 24 is not included in the construction, enabling the joinder of the socket 32 and end 36 to be effected.

From the foregoing description of a preferred embodiment of the invention, it will be perceived that the present invention provides an improved cover for a water closet seat which overcomes several disadvantages which characterize one or more of the types of seat covers previously proposed. Although a preferred embodiment of this invention has been herein described in order to explain the basic principles upon which the invention is based in a way which will enable those skilled in the art to practice the invention, it will be understood that various changes and modifications in such preferred embodiment can be effected without departure from such basic principles. Changes and innovations of this type are therefore deemed to be circumscribed by the spirit and scope of the invention, except as the same may be necessarily limited by the appended claims or reasonable equivalents thereof.

What is claimed is:

1. A cover for a water closet seat comprising:

an annular panel of flexible fabric having an inner peripheral edge and an outer peripheral edge;

a band of resilient material mounted around the outer peripheral edge of the panel;

a hem channel around the inner peripheral edge of the panel and having an opening thereinto;

a channel closure means;

a resilient, flexible stiffening member of tubular configuration in the hem channel having a first end positioned immediately adjacent said channel closure means, and a second end positioned immediately adjacent said channel closure means on the opposite side thereof from said first end, said stiffening member having a portion between said first and second ends which bridges across said channel opening; and said channel closure means extending transversely across and blocking the hem channel at one point around its peripheral extent which is spaced from said opening into the channel for preventing said stiffening member from shifting in said hem channel thereby to prevent the inadvertent exiting of either end of said stiffening member through the channel opening.

2. A cover for a water closet seat as defined in claim 1 wherein said hem channel comprises a portion of said panel turned back upon itself.

3. A cover for a water closet seat as defined in claim 2 wherein said panel is a pile fabric.

4. A cover for a water closet seat as defined in claim 2 wherein said channel closure comprises stitching extending across said hem channel.

5. A cover for a water closet seat as defined in claim 2 wherein said stiffening member is a synthetic resin tube having said first and second ends blunted.

6. A cover for a water closet seat as defined in claim 5 wherein said channel closure comprises stitching extending across said hem channel.

7. A cover for a water closet seat as defined in claim 6 wherein said panel is a pile fabric.

8. A cover for a water closet seat as defined in claim 1 wherein said channel closure comprises stitching extending across said hem channel.

9. A cover for a water closet seat as defined in claim 1 wherein said stiffening member is a synthetic resin tube having said first and second ends blunted.

10. A seat for inclusion in a water closet assembly including:

a rigid seat of annular configuration having a central opening, a back, a front, an outer peripheral edge and an inner peripheral edge, an upper side and a lower side;

a pile fabric panel of an annular configuration which is complementary to said rigid seat, said panel including:

an outer peripheral edge bearing against the under side of the rigid seat;

an annular hem channel bearing against the under side of the rigid seat and having a slot forming an opening in said hem channel at one point along its length; and a central portion between said outer peripheral edge and said hem channel and extending tautly across the upper side of said seat;

means secured to the outer peripheral edge of said panel for drawing said outer peripheral edge thereof up underneath said rigid seat;

an elongated flexible, resilient stiffening member enclosed in the hem channel, said stiffening member being of tubular configuration and having a pair of blunted ends located adjacent each other; and means, extending across the hem channel at both ends of said stiffening member and displaced from the slot in said hem channel, for separating the blunted opposite ends of the elongated flexible stiffening member from each other and for containing the stiffening member from longitudinal extrusion from said hem channel.

* * * * *